US005819620A

United States Patent [19]

Bouvarel et al.

[11] Patent Number: 5,819,620

[45] Date of Patent: Oct. 13, 1998

[54] INSTALLATION FOR CUTTING SHEET MATERIAL

[75] Inventors: Roland Bouvarel, Pessac; Régis Lallement, Cestas, both of France

[73] Assignee: Lectra Systemes, France

[21] Appl. No.: 733,466

[22] Filed: Oct. 16, 1996

Related U.S. Application Data

[63] Continuation of Ser. No. 392,779, filed as PCT/FR93/00801 Aug. 10, 1993 published as WO94/05174 Mar. 17, 1994, abandoned.

[30] Foreign Application Priority Data

Sep. 1, 1992 [FR] France ..... 92 10453

[51] Int. Cl.[6] ..... B26D 7/06

[52] U.S. Cl. ..... 83/100; 83/155; 83/155.1; 83/558; 83/937; 83/938

[58] Field of Search ..... 83/100, 152, 155, 83/660, 678, 155.1, 936, 937, 938, 939, 940, 650, 556, 558; 198/689.1; 415/119; 417/423.8

[56] References Cited

U.S. PATENT DOCUMENTS

| | | | |
|---|---|---|---|
| 3,250,164 | 5/1966 | Elsas | 83/155 |
| 3,797,341 | 3/1974 | Bystron | 83/938 |
| 3,823,629 | 7/1974 | Bleimund | 83/650 |
| 4,328,726 | 5/1982 | Pearl . | |
| 4,452,113 | 6/1984 | Pearl | 83/152 |
| 4,527,346 | 7/1985 | Schwartzott | 83/100 |
| 4,542,672 | 9/1985 | Pearl | 83/938 |
| 4,632,326 | 12/1986 | Boote et al. | 83/650 |
| 4,836,072 | 6/1989 | Gerber . | |
| 5,140,819 | 8/1992 | Napier et al. | 415/119 |
| 5,303,515 | 4/1994 | Etcheparre et al. | 83/174 X |
| 5,350,281 | 9/1994 | Hagshenas | 417/423.8 |
| 5,372,494 | 12/1994 | Vaughan | 83/660 X |

FOREIGN PATENT DOCUMENTS

| | | | |
|---|---|---|---|
| 0 252 844 | 1/1988 | European Pat. Off. . | |
| 2 535 355 | 5/1984 | France . | |
| 2 647 764 | 12/1990 | France . | |
| 2 819 441 | 11/1979 | Germany . | |
| 4112644 | 10/1992 | Germany . | |
| 2118473 | 11/1983 | United Kingdom | 83/155.1 |

*Primary Examiner*—Maurina T. Rachuba
*Attorney, Agent, or Firm*—Jones & Askew, LLP

[57] ABSTRACT

The invention relates to an installation for automatically cutting sheet material, the installation comprising at least one cutting device and at least one device for stacking sheets for cutting. The cutting device comprises a bench, and a cutting head mounted on displacement means. From its feed end to its unloading end, the bench has a cutting zone beneath which a suction cutting conveyor is mounted together with an unloading conveyor. Turbine means for creating suction are disposed beneath the unloading conveyor, and the cutting head is mounted on the face of the displacement means that face toward the feed end of the bench.

7 Claims, 5 Drawing Sheets

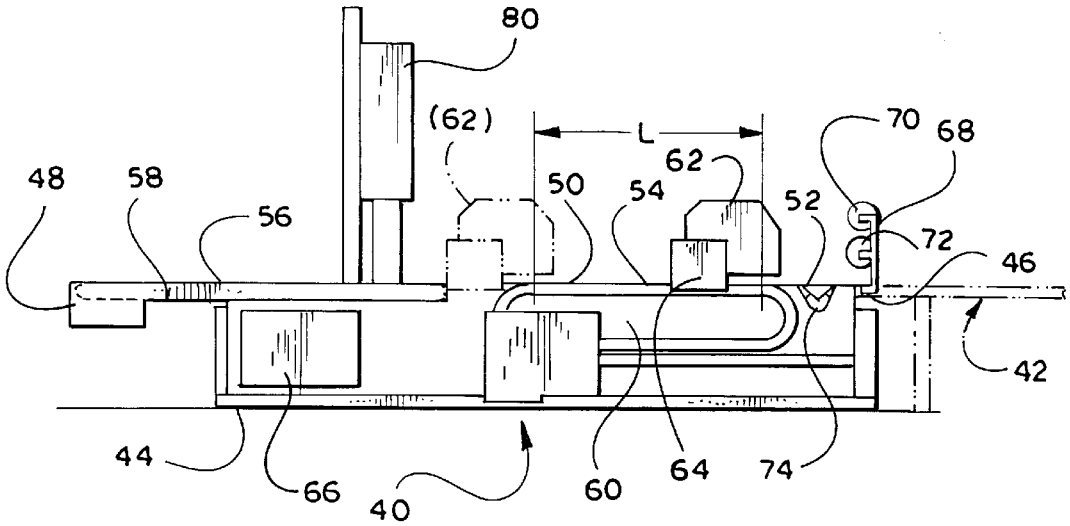
Fig_2
Fig_3
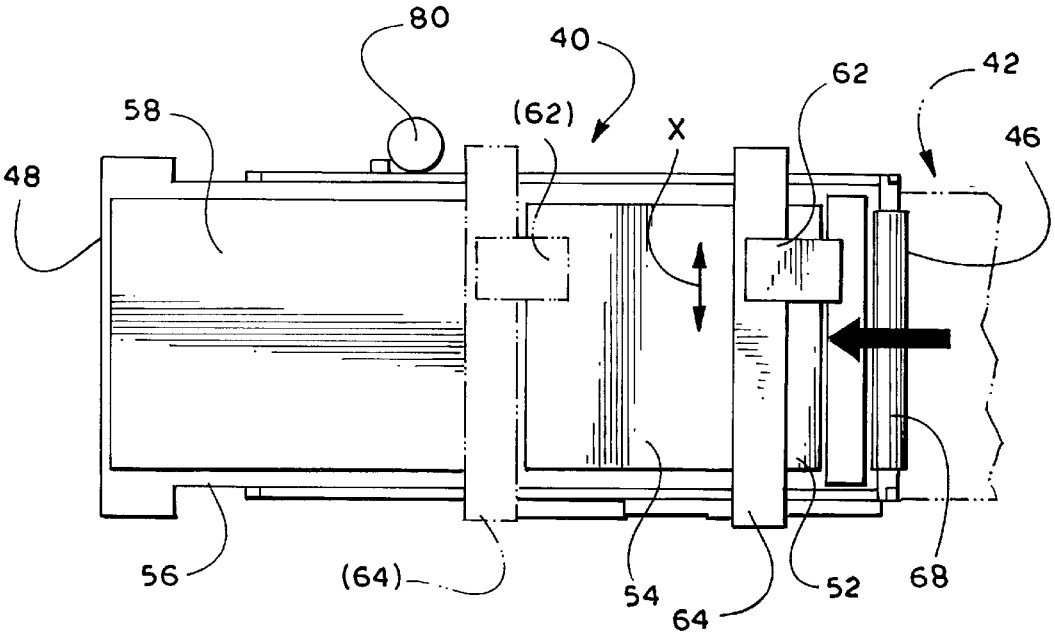

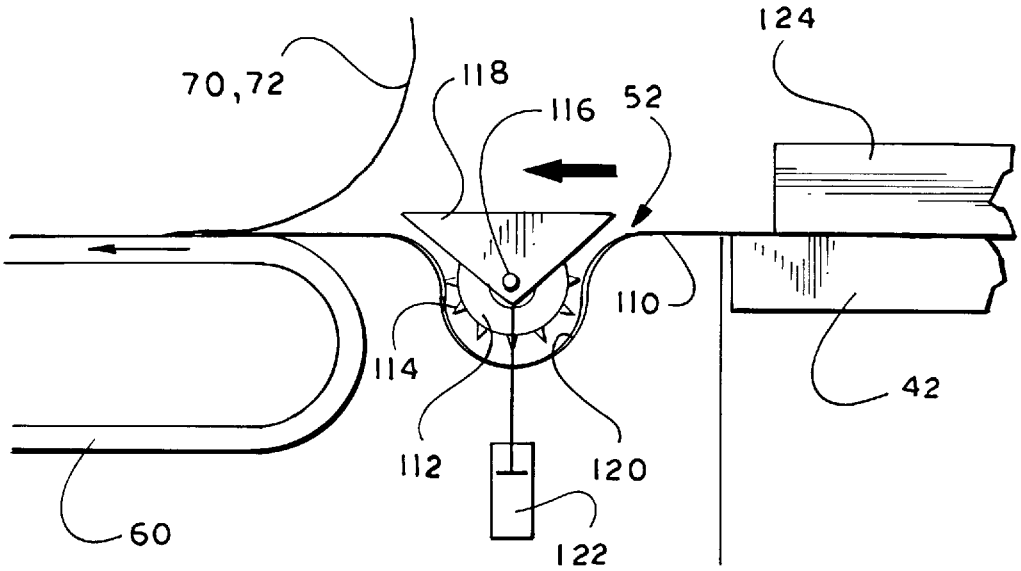
Fig. 5
Fig. 6
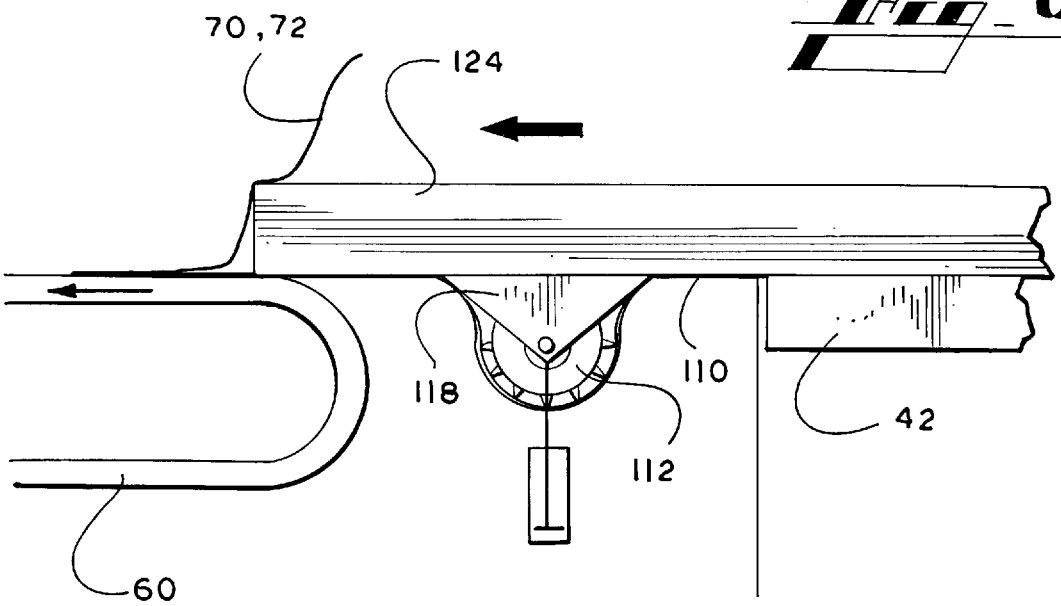

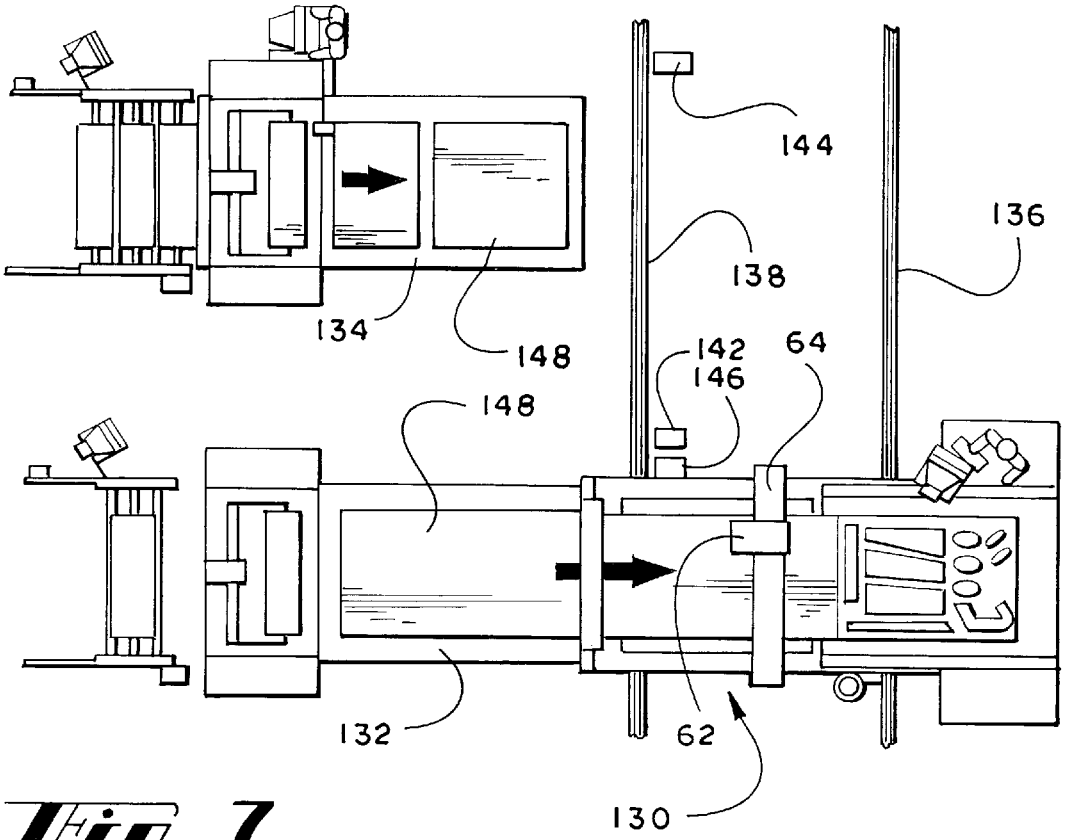
Fig. 7
Fig. 8
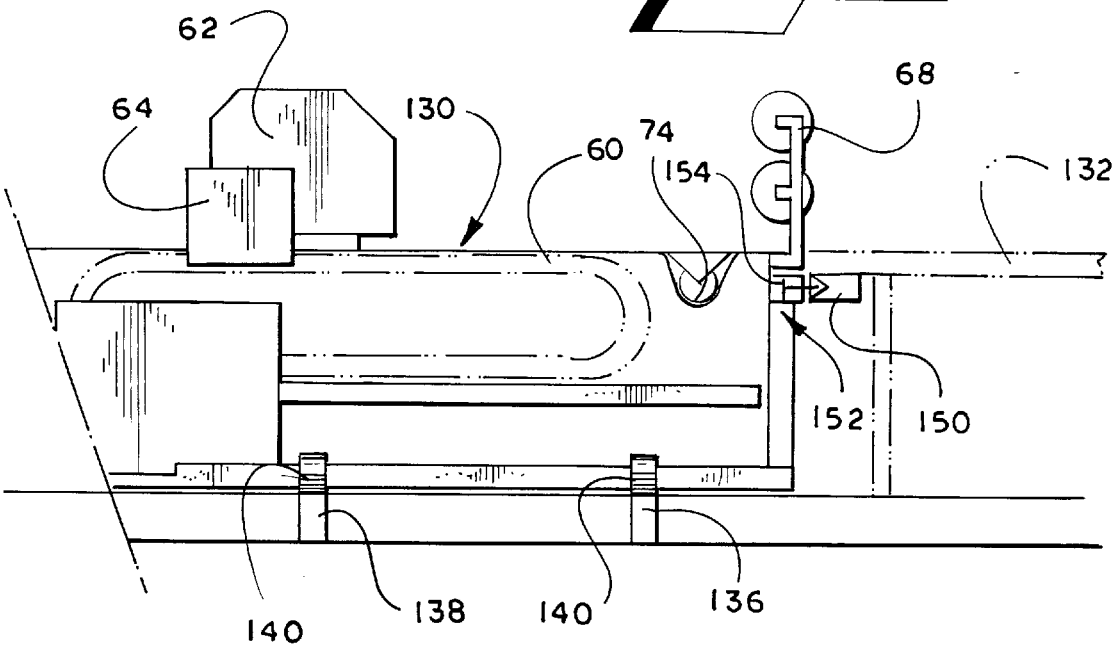

INSTALLATION FOR CUTTING SHEET MATERIAL

This is a continuation of application No. 08/392,779, filed as PCT/FR93/00801 Aug. 10, 1993, published as WO94/05174 Mar. 17, 1994, now abandoned.

The present invention relates to an installation for cutting sheet material.

More precisely, the invention relates to an installation for cutting stacks or spreads of sheets of material, in particular textile material, using a cutting head (laser beam, vibrating blades, . . . ), with the cutting head being displaced under numerical control.

Such machines are themselves well known. Nevertheless, although they give satisfaction, they raise certain difficulties in use. Firstly these machines are relatively bulky and it is therefore necessary to have a large area available in a workshop to receive them. Further, these machines are generally relatively noisy because they make use of powerful suction devices. Finally the manual actions that need to be performed in the sequence of operations implemented by these machines are not always easy for the operators to perform.

For a better understanding of the problems that arise, an installation of known type for cutting sheet material is described with reference to FIG. 1. The installation essentially comprises a cutting machine proper 10 and a spreading table 12. The spreading table is used to build up a stack of different sheets, in particular sheets of textile materials, so that pieces can be cut out simultaneously in all of the stacked sheets. The cutting machine 10 comprises a bench 14 whose top surface 16 constitutes the working face. On the working face, there are to be found in succession a feed conveyor 18 which serves to transfer the spread of sheets from the feed end of the machine to the following zone which is referenced 20 and which is the cutting zone proper. The working length of this zone is referenced L. Beneath this zone, there is a cutting conveyor 24 which serves to drive the stack of sheets during the cutting operation when the length of the sheet is greater than the cutting length L of the machine. Cutting is performed by means of the cutting head 22 which is mounted on displacement means, and in particular a gantry 26 which moves parallel to the length of the cutting zone, with the cutting head 22 being displaceable along the length of the gantry 26. Finally, there is an unloading conveyor 30 which serves to transfer the stacks of sheets once they have been cut up.

The installation also comprises a turbine suction device 32 inside the bench 14. This suction installation serves to establish suction in the conveyor 24 to ensure that the stack of sheets is entrained, and to hold the sheets stationary while they are being cut. It should also be specified that in order to obtain good suction efficiency, it is generally necessary to place a film of impervious material on top of the stack of sheets to be cut. In known machines, the film of impervious material is stored in the form of a roll 32 mounted on a roll-carrier 36 disposed over the middle of the feed conveyor 18.

An object of the present invention is to provide an installation for cutting sheet material of the type described above, but which is of smaller bulk than prior art machines and which enables the use of consumables (support paper, impervious film, . . . ) to be optimized.

Another object of the invention is to provide a cutting installation in which the noise level is reduced.

Another object of the invention is to provide a cutting installation of the type mentioned above which facilitates the actions of personnel during the manual operations that need to be performed, and to automate the transfer of material from the spreading machine to the cutting machine.

To achieve this aim, the invention provides an installation for automatically cutting sheet material, the installation comprising at least one cutting device and at least one stacking device for stacking sheets to be cut, the cutting device comprising a bench having a feed end suitable for co-operating with the outlet end of the stacking device and an outlet end for unloading sheets that have been cut out, a cutting head mounted on means for displacing it relative to the bench, a cutting conveyor, and an unloading conveyor, the installation being characterized in that the bench includes a top face that from its feed end to its unloading end defines a first zone for receiving part of the sheet stack to be cut, said zone being short, and a cutting zone beneath which the suction cutting conveyor and an unloading conveyor are mounted, in that the turbine means for creating suction are disposed beneath the unloading conveyor, in that said cutting head is mounted on the face of the displacement means that faces towards the feed end of the bench, and in that means for supporting at least one roll of impermeable film are mounted about said top face of the bench, substantially at its feed end.

It will be understood that because of the dispositions of the invention, the length of the cutting device, referred to below as the "cutter", is substantially reduced because the feed conveyor is omitted and replaced by a zone for receiving part of the stack of sheets, which zone is of shorter length. However, because the positioning of the cutting head is inverted relative to its drive means, and because the support means for the roll of impervious film are offset, enough room is left free to make it easy to put the stack of sheets to be cut together with the impervious film into place manually.

In a preferred embodiment which corresponds to the case where a perforated support sheet is to be placed beneath the stack of sheets to be cut in order to facilitate displacement thereof, the cutting machine further includes, in the zone for receiving the sheets to be cut, means for perforating the support sheet as it advances together with the stack of sheets to be cut.

This characteristic makes it possible to feed the spreading table with non-perforated support sheets (in particular conventional type paper), to put down the pile of material on the support sheet, to transfer said pile towards said perforation means by supporting it on a cushion of air beneath the support sheet which is impermeable to air, then making the support sheet permeable to air so that it is subsequently possible in the cutting zone to suck air through the stack between the support sheet and the impervious film placed on top of the stack. The cost of operating the machine is reduced insofar as non-perforated support sheets are cheaper. Another advantage that stems therefrom lies in the improvement of the conditions under which the stack is transferred from the spreading table to the cutting table insofar as prior art support sheets are delivered in perforated form and are therefore permeable, thereby reducing the quality of the support.

According to another preferred characteristic, the turbine suction means include control means for producing a first level of suction while said conveyors are in use, and a second level of suction, higher than the first, during the operation of cutting by means of said cutting head.

This disposition serves firstly to reduce electricity consumption for powering the suction turbine by providing for it to be operated at its maximum rate only during the time during which cutting is actually taking place. Secondly this disposition makes it possible to reduce the noise level that results from the suction turbine operating. Finally, this disposition makes it possible to drive the cutting conveyor by means of a motor of lower power than that which is normally provided, thereby reducing electricity consumption.

According to yet another preferred embodiment of the invention, the cutting installation includes a plurality of stationary stacking devices or "spreading" tables which are disposed parallel to one another, and a single cutting device or "cutter", means for guiding the displacement of the cutting device perpendicularly to the stacking devices, and means for controlling the displacements of the cutting device and for stopping it successively in register with each stacking device.

It will be understood that this embodiment is particularly advantageous since it enables a single cutter (which is much more expensive than the spreading tables) to be used in co-operation with a plurality of spreading tables, thereby also making it possible to prepare appropriate stacks of sheets on each spreading table while the cutter is working in co-operation with another spreading table.

Other characteristics and advantages of the present invention appear more clearly on reading the following description of various embodiments of the invention given as non-limiting examples. The description refers to the accompanying drawings, in which:

FIG. 2 is an elevation view of a cutting installation of the invention;

FIG. 3 is a plan view of the cutting installation shown in FIG. 2;

FIGS. 5 and 6 show a device for perforating paper respectively in its rest position and in its active position, which device is suitable for use in the cutting machine of the invention;

Figure 9:
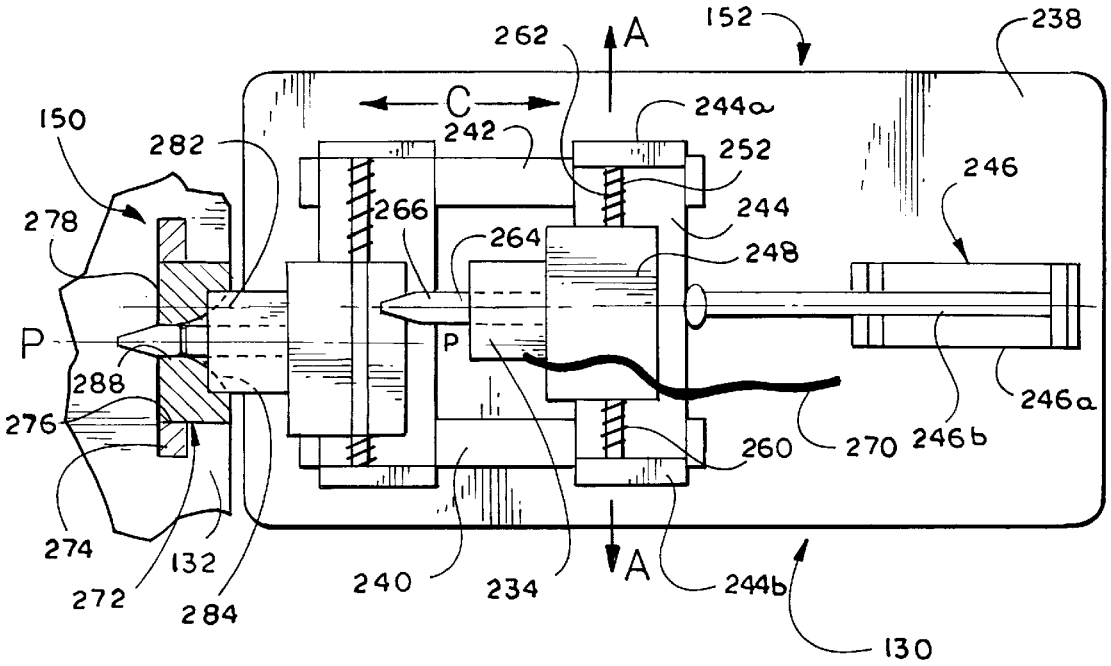
Figure 10:
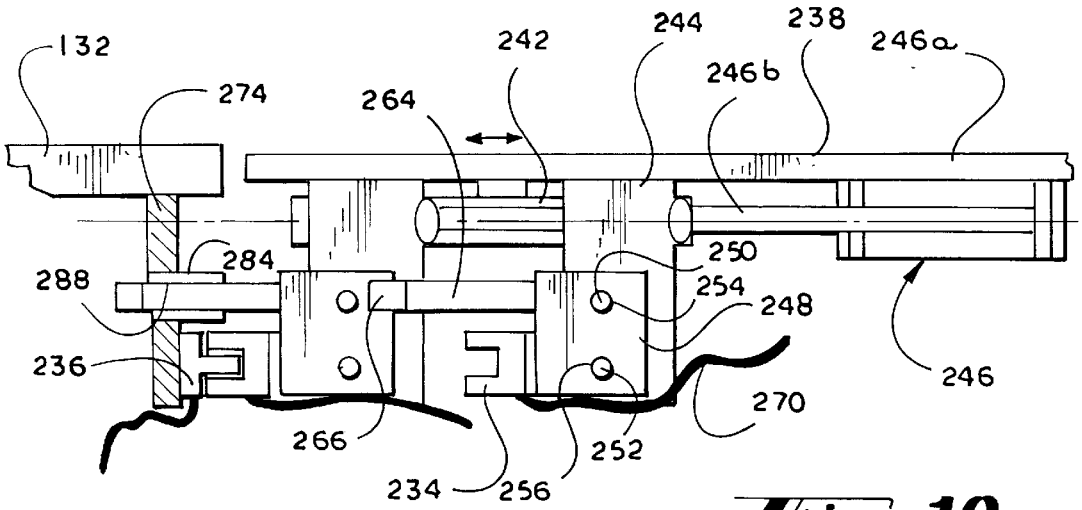

FIGS. 7 and 8 are respectively a plan view and an elevation view of a cutting installation that includes a single cutter and a plurality of spreading tables; and FIGS. 9 and 10 are a view from beneath and a side view of a connection device that is usable in the installation of FIGS. 7 and 8.

With reference initially to FIGS. 2 and 3, an overall description is given of a cutting installation constituting a first embodiment of the invention. The installation comprises firstly a cutting device or cutter 40 and secondly a spreading table or stacking device 42. The cutter 40 comprises an elongate bench 44 having a feed end 46 and a delivery end 48. The top face of the bench 44 is referenced 50 and defines firstly a zone 52 for receiving the front end of a spread of sheets, followed by a cutting zone 54 of working length L, and then an unloading zone 56 essentially constituted by an unloading conveyor 58. FIG. 2 also shows a cutting head 62 and, beneath the cutting zone 54, a suction conveyor 60 for cutting purposes. The cutting head 62 is mounted on support and displacement means that are essentially constituted by a gantry 64 which moves lengthwise over the bench in the cutting zone. The cutting head (62) and the gantry (64) shown in phantom lines show the range of movement of the cutting head 62 and the gantry 64 over the cutting zone 54. The cutting head 62 is movable in the direction X that is perpendicular to the long direction of the bench. Thus, as is well known, the cutting head can reach any point of the cutting zone 54. As shown clearly in the figure, the cutting head proper 62 is mounted relative to the gantry 64 in such a manner that its active portion is on the side of the gantry 64 facing the feed end 46 of the machine bench.

FIG. 2 also shows the box for the suction turbine assembly 66 which is located beneath the unloading conveyor 58. As is well known, ducts run from the box 66 to establish suction in the cutting conveyor 60, and thus in the cutting zone 54. FIGS. 2 and 3 also show a structure 68 for supporting two rolls of impervious film 70 and 72. The two rolls are mounted in the same vertical plane and they are parallel to each other. Both rolls 70 and 72 may be identical, which makes it possible to replace one roll during operation while the other roll is being used, or else the two rolls of impervious film are of different widths for cutting sheets of different widths, optionally in association with a device for reducing the working area for cutting, e.g. a mask of flexible material extending over the unused portion of the cutting zone.

In FIGS. 2 and 3, there is also shown in simplified manner, a device 74 for perforating a sheet of paper that is intended to facilitate displacement of stacked spreads of sheets over the spreading table, while nevertheless subsequently allowing air to be sucked through in the cutting zone so as to hold the stack down. Finally, this figure also shows in simplified manner a chimney 80 which constitutes the outlet of the suction system 66.

It will immediately be understood that by omitting the feed conveyor, the length of the cutting machine is very considerably reduced since that conveyor is replaced merely by a zone for receiving the front portion of the stack of sheets, which zone can be very short. It should also be observed that in order to make it easy to put the stack of sheets and impervious film into place by hand in the cutting zone 54, the roll-support structure 68 is located at the feed end 46 of the machine and, since the cutting head 62 projects towards the feed end, there is no longer any need to pass the material beneath the gantry 64 when initially putting the stack of sheets to be cut into place. This makes it easier for the operator to put the stack of sheets to be cut into place on the cutting conveyor 60.

Figure 1:
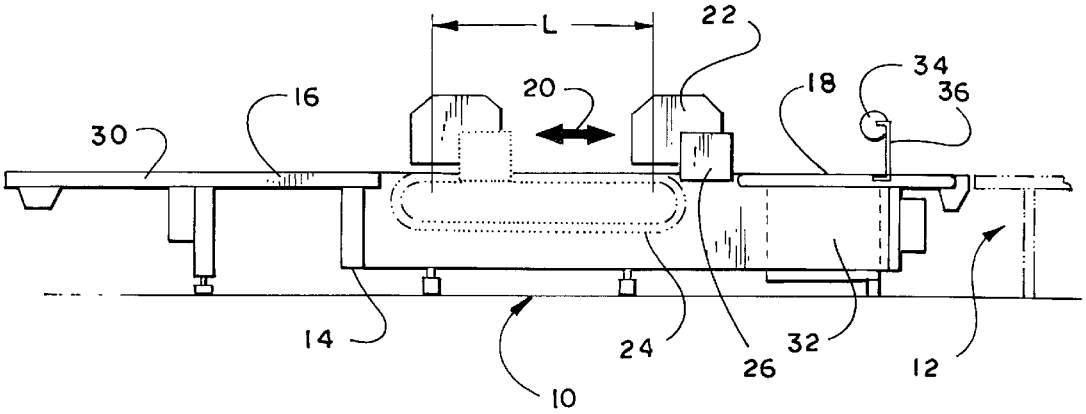
Fig. 1 PRIOR ART
FIG. 1 is described above and is a simplified diagram of a prior art cutting installation.
Figure 4:
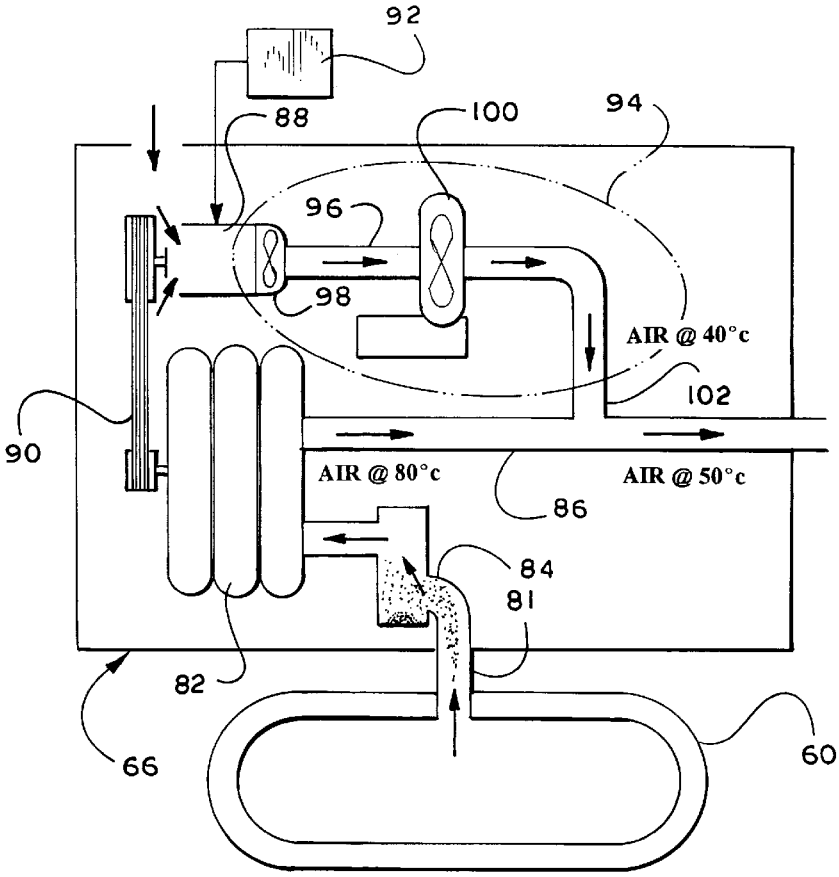
FIG. 4 is a diagram showing the suction device of the cutting machine.

With reference now to FIG. 4, there follows a description of a preferred embodiment of the suction assembly 66. In this figure, there can be seen a suction duct 80 that opens out into the bench 14 and that enables suction to be applied to the cutting conveyor 60, and thus to the cutting zone 54. This duct is connected to the input of the suction turbine 82 via a precipitation box 84. The outlet of the turbine is connected to the duct 86 which is in turn connected to a silencer 89. The turbine 82 is driven by a motor 88 that is preferably electrical, via a transmission system 90 of conventional type. In a preferred embodiment of the invention, the electric motor 88 is controlled by an associated control circuit 92 so as to enable it to rotate at at least two different speeds. Either the control system includes a frequency-varying device for varying the speed of rotation of the motor 88 and consequently the amount of suction provided by the turbine 82, or else the motor 88 has two separate windings and the control circuit 92 enables the commutator to connect one or other of the two windings of the motor to the electrical power supply.

The availability of two different levels of suction is advantageous. During stages when the stack to be cut needs to be moved, there is no need to have a very large amount of suction. In contrast, while cutting is taking place, it is necessary to have a large amount of suction available to ensure that the stack of sheet material to be cut is held quite still.

It should also be observed that by reducing the level of suction while the cutting conveyor is in use, it is possible to use a motor of lower power and thus to reduce electricity consumption.

Furthermore, electricity consumption and sound level associated with the motor 88 for driving the turbine 82 are both lower because of the reduction in the speed of said motor 88 while a low level of suction is being produced.

As can be seen in FIG. 4, the suction device also includes means for lowering the temperature of the air at the outlet of the turbine. If no special precautions are taken, the temperature of the outlet air is about 80° C.

Another object is to reduce the thermal shocks that are applied to the turbine drive motor 88 and also to reduce the temperature of the air exhausted to the outside and thus the nuisance that it might create.

This additional device given overall reference 94 is essentially constituted by a duct 96 which recovers the air driven by the fan 98 of the motor 88. An additional fan 100 is provided in the duct 96. The air thus delivered by the duct 96 has a temperature of about 40° C. The outlet 102 of the duct 96 is connected to the duct 86 downstream from the turbine 82. By mixing the two flows of air, it is possible to have an overall outlet flow at a temperature of about 50° C.

In some cases, it has been found advantageous to place a support sheet beneath the stack of sheets to be cut, thereby facilitating displacement of the stack and avoiding deformations thereof during transfers. However, the sheet must necessarily be perforated in order to enable the stack to be held in place by suction in the cutting zone.

In a preferred embodiment, the machine uses a strip of non-perforated paper 110 and the cutter includes a perforation device referenced 74 in FIG. 2. That is to say the perforation device is placed in the stack-receiving zone 52. As shown more clearly in FIGS. 5 and 6, the perforation device is constituted by a cylinder 112 of length equal to the width of the cutting table. The periphery of the cylinder is provided with perforation tools such as 114. The cylinder is mounted free to rotate on an axis 116 that is engaged in a moving cover 118. In this zone, the top surface of the cutting table is provided with a recess 120 that forms a loop in the paper, with the paper passing between the cylinder 112 and the recess 120. An actuator 122 or any other equivalent device enables the moving cover 118 to be raised and lowered together with the cylinder 112 and its perforation tools 114.

In FIG. 5, the perforation device is in its raised and inactive position so as to enable the support sheet to be inserted. In contrast, in FIG. 6, the moving cover 118 has been lowered and the perforation device is therefore in its active position. It will be understood that the sheet of paper 110 is driven simultaneously with the stack of sheets, given reference 124 in FIG. 6. The drive applied to the paper causes the cylinder 112 to rotate simultaneously and therefore causes the paper 110 to be perforated progressively.

This characteristic of the cutter makes it possible to use conventional type paper which is significantly cheaper than pre-perforated paper, and above all it makes it possible to improve transfer of the stack on a cushion of air while it is on a spreading table.

FIGS. 7 and 8 show a variant embodiment of the installation for cutting sheet material. In this installation, there is a single cutter 130 with a plurality of spreading tables 132, 134, etc. The spreading tables are disposed parallel to one another and they are in alignment. The single cutter 130 is movably mounted on rails 136, 138 which extend perpendicularly to the spreading tables. The cutter 130 is provided with a motor that controls wheels such as 140 for causing the cutter 130 to move along the rails 136, 138. A reference 142, 144 is located in association with each spreading table for co-operating with an electrical detector 146 mounted on one side of the cutter 130. Thus, when the cutter comes up to the spreading table with which it is to co-operate, the detector 146 is activated and causes the motor driving the cutter 130 to stop.

It will thus be understood that the overall cost of the installation is reduced since its most expensive portion, namely the cutter, is provided once only. However, by having different spreading tables 132, 134, it is possible to prepare a stack of sheets on one table while the cutter is in operation on another table.

It is preferable for the spreading tables to include conveyors 148 or air cushion systems to ensure proper transfer of a stack of sheets from the table to the cutting zone of the cutter 130. In order to synchronize the cutting conveyor 60 of the cutter 130 with the stack transfer means associated with the various spreading tables 132, 134, each table, e.g. the table 132, is provided with stationary electrical connector element 150 suitable for co-operating with a moving electrical connector element 152 mounted at the feed end of the cutter.

Moving electrical connector assembly 152 is preferably associated with a motor device 154 enabling pairs of connector elements to be mutually engaged automatically. In addition, the stationery electrical connector assembly 150 of the cutter 130 is preferably associated with a mechanical device for accommodating misalignment, thereby enabling possible positioning errors of the cutter 130 relative to the corresponding spreading table to be compensated.

FIGS. 9 and 10 show one such electrical connector device. The connector device comprises the moving electrical connector assembly 152 and the stationary electrical connector assembly 150. The electrical connector assembly 152 includes a female connector portion 234, as can be seen in FIG. 10, whereas the stationary electrical connector assembly 150 includes a male connector portion 236. The moving electrical connector assembly 152 includes a base 238 which is secured to the cutting machine 10, while respective stationary elements 150 are secured to the spreading tables 132, 134.

In the description below, the term "connection direction" as marked by arrow C is used to designate the direction in which the female connector portion 234 is to be displaced in order to engage the male connector portion 236. The term "adjustment direction" as marked by arrow A in FIG. 9 is used to designate the direction orthogonal to the connection direction C and parallel to the displacement direction of the machine 10. Two slideways 240 and 242 are mounted on the base 238 and are parallel to the connection direction C. A first carriage 244 is slidably mounted on the slideways 240, 242 and is therefore movable along the direction C relative to the base. The carriage 244 can be driven along the direction C by a drive member such as an actuator, preferably a double-acting actuator 246. The body **246*a* of the actuator is secured to the base 238 while the end of its rod 246*b* is associated with the first carriage 244. A second carriage 248 is mounted to move in translation on the first carriage 244 to move along the adjustment direction A relative to the first carriage. For this purpose, two guide rods 250 and 252 parallel to the direction A and disposed in the same vertical plane (assuming that the base 238 is horizontal) have their ends secured to portions 244*a* and 244*b* of the first carriage 244. The second carriage 248 is provided with two bores 254 and 256 in which the guide rods 250 and 252 are engaged. In addition, balanced return springs 260 and 262 are engaged at least on guide rod 250 on either side of the carriage 248. Thus, under drive from these two springs, the carriage 248 is held, in the absence of any external forces, in a middle, reference position. An indexing finger 264 is mounted on the second carriage 248 and extends along the connection direction C towards the electrical connector assembly 150. The indexing finger is terminated by a tapering end 266. The second carriage 248 also carries the female connector portion 234 which is itself connected to an appropriate electrical conductor 270**.

The stationery electrical connector assembly 150 of the connection device also includes a position adjusting and centering cam 272 and the male connector portion 236. The cam-forming assembly 272 is preferably constituted by a vertical plate 274 on which the male connector portion 236 is fixed. An orifice 276 is formed in said plate 274 and receives a centering system constituted by a plate 278 whose active faces 282 and 284 form two vertical sloping surface portions that are symmetrical about a vertical plane PP' parallel to the connection direction C. These two sloping guide faces converge towards an orifice 288.

The connection device operates as follows: when the cutting machine on which the moving element 230 of the connection device is fixed comes into the desired position as marked, for example, by a sensor, such detection controls activation of the actuator 246. The actuator 246 pushes the first carriage 244 along the connection direction C. When the end 266 of the indexing finger 264 comes into contact with the cam centering system plate 278, and in the event of misalignment, the second carriage 248 is displaced by co-operation between the indexing finger 264 and one of the inclined surfaces 282 or 284. Displacement continues until, under the effect of such centering, the end of the finger penetrates into the orifice 288 that extends the inclined guide faces. In this situation, the female connector portion 234 is in accurate alignment with the male connector portion 236 secured to the plate 274. The stationery electrical connectors assembly 150 and moving electrical connector assembly 152 can therefore be mutually engaged under very good conditions since the connector portions are in accurate alignment.

In FIGS. 9 and 10, the carriages 244 and 248 are shown in solid lines in a rest, first position, and the same carriages are shown in dashed lines in the position they occupy when an electrical connection is established.

It will be understood that in this embodiment, complete automation is thus obtained of the operation of the installation for cutting stacks of sheets.

What we claim is:

1. An installation for automatically cutting sheets of material, said installation comprising:

a plurality of stacking devices for stacking said sheets to be cut, said stacking devices including an outlet end, and a first electrical connection assembly, said first electrical connection assembly including an indexing element, a first connector portion, and mounting means having a set of two moving supports for enabling said indexing element and said first connector portion to move in two orthogonal directions, said first connector portion and said indexing element being mounted on said mounting means; and at least one cutting device, said cutting device including a second electrical connection assembly for cooperating with the first electrical connection assembly when the cutting device is in register with a corresponding stacking device, said second electrical connection assembly including a first connector portion, and a cam assembly, said cam assembly cooperating with said indexing element of said first electrical connection assembly for adjusting the position of said second electrical connection assembly along a displacement direction of the cutting device relative to the first electrical connection assembly of the corresponding stacking device, said cutting device further including a bench having a feed end, said feed end including means for mating with the outlet end of the stacking devices, a bench outlet end for unloading said sheets that have been cut out, and a top surface extending from said feed end to said bench outlet end, that defines a cutting zone, a support means which is displaceable with respect to said bench, said support means having a surface that faces the feed end of said bench, a cutting head mounted on said surface of said support means facing said feed end, a cutting conveyor and unloading conveyor, both conveyors being mounted beneath said top surface of said bench, turbine means for creating suction, said turbine means being disposed beneath said unloading conveyor, and means for supporting at least one roll of impermeable film, said supporting means being mounted about said top surface of said bench, substantially at the feed end of said bench, before said cutting head.

2. An automatic cutting installation according to claim 1, wherein said means for supporting rolls of film comprise means for simultaneously supporting two rolls.

3. An automatic cutting installation according to claim 1, in which a support sheet is placed on the cutting zone beneath a stack of the sheets to be transferred, the installation further including, between the feed end and the cutting zone, a zone for receiving the stack of the sheets to be cut, said zone being of lesser length than width and being provided with perforating means for perforating said support sheet as said support sheet advances together with said stack of the sheets in a displacement direction towards the cutting zone.

4. An automatic cutting installation according to claim 3, wherein said perforation means comprise a cylinder with perforation tools on a lateral face, said cylinder being mounted for free rotation about a horizontal axis perpendicular to the displacement direction of the stacks of sheets, and means for displacing said horizontal axis of said cylinder between an active position in which said cylinder perforates the support sheet and an open position in which it is possible to insert said support sheet.

5. An automatic cutting installation according to claim 1 wherein the turbine means include control means for producing a first level of suction and a second level of suction, higher than the first level of suction, the second level of suction used during the operation of cutting by said cutting head.

6. An automatic cutting installation according to claim 1, wherein said stacking devices are disposed parallel to one another, and further comprising means for guiding displacement of said cutting device perpendicularly to said stacking devices, means for controlling the displacement of said cutting devices, and means for stopping said cutting device successively in register with each stacking device.

7. An automatic cutting installation according to claim 1, wherein said turbine means for creating suction comprises:

a turbine having an outlet, silencer means, a first duct for connecting the outlet of said turbine to said silencer means, a motor for driving said turbine, means for lowering the temperature of the air arriving at the silencer means from the outlet of said turbine comprising fan means for cooling said motor and a second duct for connecting said fan means to said first duct.

* * * * *